United States Patent [19]

Ganter

[11] Patent Number: 5,036,500

[45] Date of Patent: Jul. 30, 1991

[54] AUTONOMOUS RADIO TIME PIECE HAVING A RESETTABLE RECEIVER ACTUATION SWITCH

[75] Inventor: Wolfgang Ganter, Schramberg-Sulgen, Fed. Rep. of Germany

[73] Assignee: Junghans Uhren GmbH, Schramberg, Fed. Rep. of Germany

[21] Appl. No.: 452,336

[22] Filed: Dec. 19, 1989

[30] Foreign Application Priority Data

Dec. 20, 1988 [DE] Fed. Rep. of Germany ..... 8815765

[51] Int. Cl.[5] ..... G04C 11/02

[52] U.S. Cl. ..... 368/47

[58] Field of Search ..... 368/10, 46, 47, 49, 368/59, 60, 61, 185–187; 455/12, 51

[56] References Cited

U.S. PATENT DOCUMENTS

| | | | |
|---|---|---|---|
| 3,795,099 | 3/1974 | Tsuruishi | 368/113 |
| 3,937,004 | 2/1976 | Natori et al. | 368/10 |
| 4,131,855 | 12/1978 | Hamagawa | 368/47 |
| 4,175,377 | 11/1979 | Ichikawa | 368/66 |
| 4,201,041 | 5/1980 | Tanaka | 368/85 |
| 4,204,398 | 5/1980 | Lemelson | 368/47 |
| 4,255,803 | 3/1981 | Sekine | 368/72 |
| 4,301,524 | 11/1981 | Koepp et al. | 368/261 |
| 4,315,332 | 2/1982 | Sakami et al. | 455/181 |
| 4,316,273 | 2/1982 | Setter | 368/47 |
| 4,396,293 | 8/1983 | Mizoguchi | 368/15 |
| 4,543,657 | 9/1985 | Wilkinson | 375/1 |
| 4,582,434 | 4/1986 | Plangger et al. | 368/46 |
| 4,823,328 | 4/1989 | Conklin et al. | 368/47 |

FOREIGN PATENT DOCUMENTS

| | | |
|---|---|---|
| 3015312 | 10/1981 | Fed. Rep. of Germany . |
| 3439638 | 5/1986 | Fed. Rep. of Germany . |
| 3510636 | 9/1986 | Fed. Rep. of Germany . |
| 55-90883 | 7/1980 | Japan . |
| 56-79281 | 6/1981 | Japan . |

OTHER PUBLICATIONS

Funkferngesteuerte Uhren (Radio Control Time Pieces), Dipl.-Ing. G. Krug, Ruhla, 1971.

Langwellenuhr Mit Dem Mikrocomputer (Long Wave Time Piece with a Microcomputer).

Funkuhren, herausgegeben von Prof. Dr.-Ing. Wolfgang Hilberg, 1983, pp. 104–109.

Mikrocomputergesteuerte Funkuhr im Mini-Format, R. Goessler, 1979.

*Primary Examiner*—Vit W. Miska

*Attorney, Agent, or Firm*—Burns, Doane, Swecker & Mathis

[57] ABSTRACT

An autonomous radio timepiece with a receiver for receiving time telegram information to be decoded and a reset switch for the restarting the reception, decoding and display functions. The timepiece is structured so that manual actuation is still be possible, and erroneous actions affecting the processor relative to the execution of time telegram decoding and the control of time derived functions are prevented. For this purpose, optionally in addition to the conventional reset switch installed in a covered manner, a separate receiver switch is provided, whereby the receiver may be actuated temporarily and optionally the time display unit then reset into a reference position. If the receiver is not provided with a usable time information within a predetermined period time, the time display unit is reset to the value of the time register in order to display the time incremented in the register in a normal time keeping manner or the time instantaneously verified by radio, without affecting other time derived functions, such as an alarm emission program, by such intermittent actuation of the receiver. Thus, the time which has been incremented in said register in a time keeping manner is displayed.

9 Claims, 1 Drawing Sheet

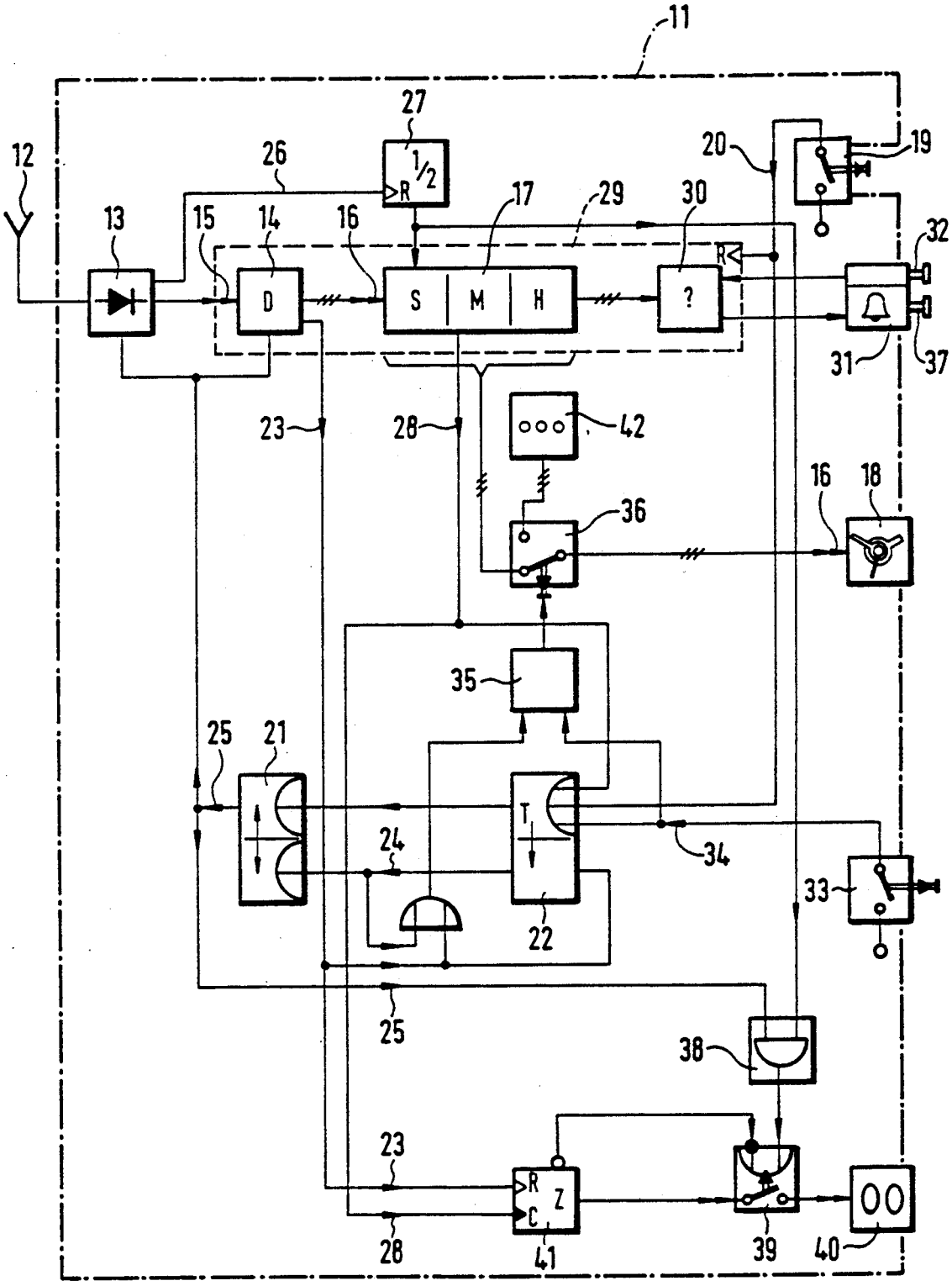
11
12
13
14
15
16
17
18
19
20
21
22
23
24
25
26
27
28
29
30
31
32
33
34
35
36
37
38
39
40
41
42
D
S
M
H
?
R
1/2
T
Z
C

AUTONOMOUS RADIO TIME PIECE HAVING A RESETTABLE RECEIVER ACTUATION SWITCH

BACKGROUND OF THE INVENTION

The present application is related to a copending application entitled "Autonomous Radio Timepiece Capable of Automatic Correction Regardless of Time Zone Changes" in the name of the present inventor, filed on or about the date of filing of the instant application.

1. Field of the Invention

The present invention relates to an autonomous timepiece having a switch for temporarily actuating an associated receiver.

2. The Related Art

A radio timepiece of this type, which gained success in the market very rapidly, is known from the article by W. Ganter "JUNGHANS Radio timepiece RC 2" in Goldschmiede-Zeitung No. 1/1988, page 148. This radio timepiece activates the receiver periodically temporarily, at predetermined points in time, in order to correct the instantaneous time display, if necessary, in keeping with time telegrams received by radio In addition, the receiver is actuated by the insertion of a battery or in operation by the actuation of a sender call key, whereby the instantaneous time display is simultaneously set to the 00:00:00 H reference position and system reset of the processor is actuated. Upon system reset, the time telegram is decoded and the time information is cOnverted into a control signal for the time display As soon as a valid time telegram is received by radio, the receiver is deactivated and the time display is rapidly set to the corresponding position. If the time display is operated by optoelectronic means, the electrical actuation of the corresponding optical segments or sector takes place practically without delay. If, however, it is necessary to move mechanical parts in the process, for example, a clock mechanism for driving the clock hands, or the drive for digital drop disks, the finite time required for this operation is automatically taken into consideration in the resetting operation, so that the actual instantaneous time can be displayed even in the case where mechanical drive mechanisms are used.

However, the resetting of the processor by an operating key upon the actuation of the receiver may be found to be troublesome if it is actuated unintentionally, thereby deleting the contents of the memory present in the processor. In this case, a certain period of time is required until sufficient time telegrams may be received and decoded to determine their plausibility in order to reset the register contents and, from the register contents, resetting the time display to the correct instantaneous time. This is especially annoying if the radio timepiece is located at the edge or outside the receiving range of the time sender. In this case, the undisturbed reception of time telegrams may not be immediately feasible and may be delayed for a few hours, or even through the following night. Until the radio timepiece comes into receiving range, display of accurate time information cannot occur. If the radio timepiece is embodied as a wristwatch, unintentional actuation of the reset key is possible under conditions of normal wear. If the radio timepiece is an alarm clock, i.e., capable of emitting an alarm at a predetermined point in time, it may happen that someone erroneously actuates the processor reset key, while it was actually intended to initiate an alarm repeat program. However, the alarm will be interrupted and the repeat program not be initiated, if the processor and all of its control functions has been reset, albeit mistakenly.

SUMMARY OF THE INVENTION

In view of these conditions, it is an object of the present invention to overcome the above-noted disadvantages.

It is a further object of the present invention to retain, in the case of a radio timepiece of the above-described generic type, the proven simple method of receiver actuation (for example, without having to change the battery).

It is a further object of the present invention to prevent interference with the operation as the result of an erroneous actuation.

These objects are attained according to the present invention essentially by equipping the radio timepiece of this type with a receiver switch which can actuate the receiver without resetting the time register which is connected following the decoder and the function circuits depending on such decoder.

This solution provides a switch which, as heretofore noted, may be designated a sender call key, but the actuation of which does not reset the processor, but merely actuates the receiver temporarily. The display is conveniently moved into a defined reference position, in order to indicate that a new synchronization of the timepiece is imminent. However, if the reception should not lead to usable time information, the receiver is deactivated to reduce the power requirements of the timepiece and the time display means operated from the register (the contents of which have not been deleted but instead have been stepped forward). Any erroneous or playful actuation of the receiver switch thus, in case of poor receiving conditions, does not lead to a prolonged loss of the time display. The time display remains correct and other optionally entered functions, such as, for example, an alarm program, are also not deleted and are available without the need for new entries for time dependent activation or undisturbed operation following their activation. In addition, the periodic, for example, hourly or daily temporary actuation of the receiver, controlled by the undeleted register, continues in order to regulate and potentially correct the actual time display on the basis of instantaneously received time telegrams.

In spite of the separation of the effect of the receiver switch on the operation of the processor, for example, the decoding of time telegrams received and the subsequent further functions, such as displays and alarm comparators, it may be convenient to actuate the processor reset operation manually. For this purpose, the conventional reset switch may be provided which is covered, for example, recessed or built in, so that it cannot be actuated unintentionally. The actuation then requires auxiliary means, such as, for example, the tip of a pencil, in order to intentionally reset the processor, for example, when due to a trip into the receiving zone of another sender or a different time zone, or any other reason, a complete resetting of the radio timepiece appears to be desirable.

It is appropriate to communicate to the user of the radio timepiece information relating to how long ago the last control and possible correction of the time display on the basis of a received time telegram received took place, and what uncertainties may affect the present time display. To this end, it is convenient to count the cycles in which the periodic, processor controlled temporary reactuation of the receiver has taken place without leading to receipt of valid time information. The result of the counting is displayed, for example, in hours in the case of hourly receiver actuation or in days if there is daily actuation. This display is reset to the initial value of the counter (zero) or entirely deleted if the decoding of a time telegram leads to an evaluatable time information: merely the appearance of a display then indicates that extraordinarily poor receiving conditions exist, i.e., that for an extended period of time the accuracy of the time displayed could not be tested. If and while the receiver is on either as the result of periodic actuation from the time register of the processor or of the receiver switch or reset switch, this fact is communicated to the user by providing that the display, independently of the instantaneous content of the display, emits a conspicuous signal, for example, by blinking. In this manner the user of the radio timepiece simultaneously receives a confirmation of the fact that the manual actuation of the switch has lead to the activation of the receiver as intended and now in the case of adequate receiving conditions, would result in the monitoring and possible correction of the time display, together with the simultaneous resetting of any counter total for the number of attempts at reception.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

The invention of the present application will now be described in more detail with reference to the preferred embodiments of the device, given only by way of example, and with reference to the accompanying drawings, in which:

The single figure shows, in a single pole block circuit diagram, an autonomous radio time piece with a sender call key, the actuation whereof does not lead immediately to the resetting of the processor for the obtention and procession of time derived information.

DETAILED DESCRIPTION OF THE PREFERRED EMBODIMENTS

The radio timepiece 11 according to the present invention comprises a receiver 13 connected with an antenna 12 and tuned or tunable to a time sender frequency with a decoder 14 for decoding the instantaneous time information 16 contained in the demodulated receiver information 15. This decoded time information is entered into a register 17 for the actuation of a time display device 18, which, as indicated in the drawing may be a hands setting or (not shown) a digital numerical display of the instantaneous time information 16. In both cases, the display may be effected by means of mechanically moved elements, for example, hands or drop disks, or by the segment or sector actuation of electro-optical displays.

A reset switch 19 may be provided, the manual activation of which results in the generation of a reset signal 20, which by means of a bistable circuit 21, switches on the receiving device (receiver 13 and possibly the decoder 14), which in order to save power is usually off, particularly in the case of a battery operated radio timepiece 11. Following a predetermined period of time T, shown in the drawing as a monostable or time circuit 22, or if the radio reception has produced an evaluatable time information 16 and a reception confirming signal 23 has therefore appeared, a deactivation pulse 24 is produced, which resets the bistable circuit 21 into the initial state, thereby terminating the actuation signal 25. The receiver 13, in case of undisturbed radio reception, synchronizes the phase position of an autonomously free-running time keeping circuit 27 by means of a synchronizing line 26 and the circuit 27 now transmits the time information 16 entered instantaneously by the receiver 13 for continuous display by the time display device 18. Upon the repeated actuation of the reset switch 19, or periodically, for example, on the hour which is decoded in the time register 17 and leads to the emission of an actuation pulse 28, the receiver is again activated for the predetermined time period T, if no reception confirmation signal 23 appears prior to the completion of the period T to deactivate the receiver 13.

The reset signal 20 also leads to a system reset of the processor 29, in which the functions are carried out: causing the decoder 14 to deliver the time information 14 instantaneously received by radio; causing the time register 17 to actuate the time display 18; and causing the coincidence circuit 30 to actuate other time derived functions on a time-related basis. These further functions may relate in particular to the actuation of at least one terminal signal transducer 31 upon the attainment of a given point in time, that may be predetermined by means of a manual handle 32. This means, however, that the information of the coincidence circuit 30 is also deleted and therefore no alarm signal, which may have become due, is emitted or that an alarm set for this time cannot be run by its program, for example, a snooze repeat function.

For this reason, the reset switch 19, if not eliminated altogether, is built conveniently into the timepiece 11 in the form of a wristwatch and/or an alarm clock, so that it cannot be actuated erroneously, for example, by a manipulating reflex motion upon the appearance of an alarm signal or by an unintentional impact on a wristwatch. In its place, or in addition, a receiver switch 33 is provided, the actuation of which, in the circuit example shown by means of a further OR inlet of the time circuit 22, activates the receiver actuation signal 25 without leading to a simultaneous processor system reset. The actuation of the switch 33 by way of a memory 35 and a reversing switch 36 further effects a display reset, so that the time display unit 18 is moved into a predetermined reference position, which may coincide with the reference position due to the appearance of a processor reset and which, for example, may consist of the time display of 00:00:00 hours. The function of the processor 29 is retained in a time keeping manner, i.e., for example the actuation of the coincidence circuit 30, triggers a normal alarm emission program that may be affected by a shutdown switch 37.

The reset actuation of the time display unit 18 triggered by the receiver switch 33 is cancelled, the display unit 18 again controlled with the correct time from the register 17, if either the activation of the receiver has been successful and has lead, in addition to the decoding of an instantaneous time information 16 received by radio, to the appearance of an actuation signal 23 at the output of the decoder 14, or if after a predetermined period of time T no reception information 15 has been decoded and therefore, in order to save power, the receiver is deactivated by the pulse 24.

It may be of practical interest to the user of a radio timepiece, especially in the case of an alarm clock, to know how secure the time information 16 displayed instantaneously is compared to the information 15 received by radio, i.e., at what time the instantaneously displayed time information 16 has been most recently compared with a decodable time information 15 received. The smallest comparison cycle Z is determined by the intervals in which the switching pulse 28 actuated by the register 17 appears, for example, hourly. The receiver actuation signal 25 triggered by this, or by a manual switching signal 34, intermittently controls by means of an interrupter circuit 38 and a switching interval 39, a control display 40. In this manner, in addition to the display reset of the time display unit 18, the fact that an attempt at reception is being made at the moment in order to update the time information 16 is indicated. If the attempt has been successful, or has been discontinued after a predetermined period of time T without any result, and if therefore the actuating signal 25 disappears, the intermittent activation of the control display 40 is cancelled and preferably, for example, a digital liquid crystal display is switched off altogether. However, the control display 40 is reactivated, not intermittently but permanently, when a cycle counter 41 affected by the register switch-on pulse 28 counts up from its zero setting, because at least the first attempt at reception automatically actuated by the switch-on signal 25, did not lead to decodable time information signal 15. The statically displayed information on the control display 40 therefore indicates, in the example presented, how many (hourly) cycles have passed since the time information 16 for the time display unit 18 has been confirmed by a time information signal 15 and corrected.

The user of the radio timepiece 11 may now trigger another attempt at reception by the receiver switch 33 as described above, so that it is not necessary to await the next cycle of the appearance of a switch-on signal 25. The cycle counter 41 is reset into its initial counting position and the control display 40 deactivated by the switching section 39, as soon as a reception attempt has been successful, i.e., has lead to a decoded time information 16 and the emission of the confirmation signal 23.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology of terminology employed herein is for the purpose of description and not of limitation.

What is claimed is:

1. An autonomous radio controlled timepiece comprising a receiver, a processor means connected to said receiver including a time register for storing an actual time value, a decoder connected to said time register, a receiver switch operably connected to said receiver for temporarily actuating said receiver without resetting said time register, a time display unit connected to said time register, means for setting a maximum receiver actuation period connected to said receiver switch, and means for temporarily setting said time display unit to a reference position and for returning, following termination of the maximum receiver actuation period, to the actual time value stored in said time register being responsive to actuation of said receiver by said receiver switch.

2. The radio controlled timepiece according to claim 1, wherein said processor means further comprises a coincidence circuit connected to said time register for comparing the actual time value in said time register to a predetermined time and actuating a set time signal transducer.

3. The radio controlled timepiece according to claim 1, further comprising a reset switch means operably connected to said processor and said receiver for actuating of the receiver and the resetting of at least substantially all registers within said processor.

4. The radio controlled timepiece according to claim 3, further comprising a cycle counter for counting each actuation of said receiver effected from said receiver switch or said reset switch means or periodically from said time register, said counter being reset into a reset position if evaluatable time information is received by said receiver and a display for displaying the actual value of said cycle counter.

5. The radio controlled timepiece according to claim 4, wherein said display is deactivated as long as the value of said cycle counter is not different from the reset position of the cycle counter.

6. The radio controlled timepiece according to claim 5, wherein said display is operable in a different mode as long as said receiver is actuated.

7. The radio controlled timepiece according to claim 5, wherein said display is operable in a different mode as long as said receiver is actuated.

8. The radio controlled timepiece according to claim 6, comprising an interrupter circuit for intermittently actuating said display.

9. The radio controlled timepiece according to claim 7, comprising an interrupter circuit for intermittently actuating said display.

* * * * *